US006300876B1

(12) United States Patent
Sakurai et al.

(10) Patent No.: US 6,300,876 B1
(45) Date of Patent: Oct. 9, 2001

(54) FIRE DETECTOR

(75) Inventors: Kazuyoshi Sakurai; Ichiro Hamada; Yasunori Oya, all of Tokyo (JP)

(73) Assignee: Nittan Company Limited, Tokyo (JP)

( * ) Notice: Subject to any disclaimer, the term of this patent is extended or adjusted under 35 U.S.C. 154(b) by 0 days.

(21) Appl. No.: 09/513,690

(22) Filed: Feb. 25, 2000

(30) Foreign Application Priority Data

Apr. 28, 1999 (JP) ..... 11-122757

(51) Int. Cl.[7] ..... G08B 17/10

(52) U.S. Cl. ..... 340/630; 340/577; 340/628; 250/554; 250/574

(58) Field of Search ..... 340/577, 578, 340/600, 628, 630; 250/554, 573, 574

(56) References Cited

U.S. PATENT DOCUMENTS

| | | | | |
|---|---|---|---|---|
| 3,916,209 | * | 10/1975 | Steele et al. | 250/574 |
| 3,934,148 | * | 1/1976 | Collins | 250/458.1 |
| 4,250,500 | | 2/1981 | Schade, Jr. | 340/628 |
| 4,547,673 | * | 10/1985 | Larsen et al. | 250/554 |
| 4,904,982 | * | 2/1990 | Lieb et al. | 340/326 |
| 4,906,978 | * | 3/1990 | Best et al. | 340/630 |
| 5,750,959 | * | 5/1998 | Plumptre | 269/465 |

FOREIGN PATENT DOCUMENTS

| | | |
|---|---|---|
| 3806217 | 9/1989 | (DE) . |
| 0940788 | 9/1999 | (EP) . |

* cited by examiner

*Primary Examiner*—Van T. Trieu
(74) *Attorney, Agent, or Firm*—Staas & Halsey LLP

(57) ABSTRACT

A fire detector which can be observed an operating state thereof from every direction and decrease a cost thereof as possible. The fire detector (10) comprises: the circuit board (32) in which the circuit for detecting a fire is formed; the LED (35) which is surface-mounted on the circuit board (32); and the indication lamp for indicating the fire detector being under detection by emitting the light emitted from the LED (35), wherein the indication lamp comprises the light guide member (20) for introducing the light emitted from the LED (35) to the indication lamp with a ring shape, the light guide member (20) comprises the light incident parts (21) and (21) and the ring member (22), notches (23) and (23) are formed in the vicinity of the light incident parts (21) and (21) of the ring member (22), and a plurality of small grooves (24), and (24) . . . are formed in the bottom surface **(22*d*) of the ring member (22)**.

18 Claims, 13 Drawing Sheets

FIRE DETECTOR

BACKGROUND OF THE INVENTION

1. Field of the Invention

The present invention relates to a fire detector provided with an indication lamp.

2. Description of Related Art

According to a conventional fire detector, most of indication lamps for indicating the fire detector being under detection, are provided at one position on a surface of the fire detector, for example, as disclosed in Japanese Utility Model Application Publication (Examined) No. Jitsuko-sho 61-1511 and Japanese Utility Model Application Publication (Unexamined) No. Jitsukai-sho 58-189954.

An example of such a type of conventional fire detector is shown in FIGS. 14A and 14B. FIG. 14A is a plan view of such a conventional fire detector. FIG. 14B is a side elevation view of the conventional fire detector. In FIGS. 14A and 14B, the reference numeral 1 denotes a fire detector for detecting a fire, and the reference numeral 2 denotes an indication lamp for indicating the fire detector being under detection by emitting a light.

As shown in the FIGS. 14A and 14B, when one indication lamp is provided at one position on the fire detector, an indicating state of the indication lamp cannot be observed from a specific direction. Therefore, there is a large possibility that the indicating state of the indication lamp cannot be observed from a direction in a range.

Accordingly, a situation such that it is not possible to observe whether the fire detector is operating or not, may occur. Further, in order to observe an operating state of the fire detector, people have to move to a position at which they can recognize the indication lamp. As a result, it is not convenient. Further, when the fire detector is attached to a ceiling, in order to set the indication lamp in a direction easiest to recognize the indication lamp, it is necessary to contrive an attachment direction of the fire detector. As a result, a work for attaching the fire detector to a ceiling has taken much time.

In order to solve such a problem concerning the attachment direction of the fire detector, at least either a detector base or a detector body case, of the fire detector, is made of opaque plate which can transmit a light, as disclosed in Japanese Utility Model Application Publication (Examined) No. Jitsuko-sho 57-47913. Therefore, it is possible to observe an operating state of the indication lamp which is disposed in an inside of the detector body case, from the whole circumference.

However, in order to realize such a type of indication lamp, it is not possible to arrange another part between a light source of the indication lamp and the opaque plate which can transmit a light. That is why, another part which is arranged between the light source of the indication lamp and the opaque plate, prevents the light from transmitting. Therefore, it is not possible to arrange another part between the light source of the indication lamp and the opaque plate so that it is difficult to realize such a type of indication lamp.

Further, when a technique of the Publication is realized and a fire detector using the technique is attached in a bedroom of a hotel or the like, the whole fire detector goes brightly on and off during the night so that the fire detector may give an anxiety to a person who is in a room. Further, the light of the fire detector is too bright so that the fire detector may prevent the person from sleeping.

Further, conventionally, various types of fire detectors such as a heat type detector, a smoke type detector, a multi-sensor, or the like, are known.

However, in a conventional fire detector, not only a detecting part but also every part incorporating a covering body, of the fire detector, have been designed and manufactured individually for each type. Therefore, it requires a higher production cost for the fire detector.

SUMMARY OF THE INVENTION

The present invention was developed in view of the above-described problems.

An object of the present invention is to provide a fire detector provided with an indication lamp which can be observed whether emitting a light or not, from every direction and which can be controlled so as to be an appropriate state at a bedtime or the like. Another object of the present invention is to provide a fire detector which requires only a lower production cost as possible.

In the following explanation of the summary of the present invention, a corresponding element in the preferred embodiment of the present invention will be shown in a parenthesis, as an example. When the same term as one in the preferred embodiment of the present invention, is used, only a reference numeral thereof will be indicated.

In accordance with one aspect of the present invention, the fire detector (10) comprises: a circuit board (32) in which a circuit for detecting a fire is formed; a light source (LED 35) which is connected with the circuit board; and an indication lamp for indicating the fire detector being under detection by emitting. a light emitted from the light source, wherein the indication lamp is formed in a predetermined shape (for example, in a ring shape) substantially centered on a central line which passes through a top portion (a portion which is faced to a floor surface when the fire detector is attached to a ceiling) of a covering body.

Herein, the indication lamp may be formed in the predetermined shape substantially centered on the central line, so as to incorporate the central line or to surround the central line.

According to the fire detector having such a structure, the indication lamp of the fire detector is formed in the predetermined shape substantially centered on the central line which passes through the top portion of the covering body. As a result, the indication lamp is formed in the predetermined shape hardly having a specific direction so that it is possible to observe whether the fire detector is operating or not from every direction.

Preferably, in the above-described fire detector, the predetermined shape of the indication lamp includes a ring shape, a plate-like shape, a cylindrical shape, and a shape having a pattern which is formed continuously and regularly along a circle.

Herein, the ring shape is not limited to a circle. The ring shape may be stripe-like or band-like so as to be approximately continuous. The plate-like shape may be one covering at least one portion of the top portion on the fire detector without having a specific direction. For example, the plate-like shape may be disc-like, a regular-polygonal, or the like. The cylindrical shape may be formed so as to cover only a side surface of the fire detector or may be one covering from the side surface to the top portion of the fire detector. Further, the pattern which is formed continuously and regularly along a circle, may be one, for example, a small groove or a bending portion having an arch-like shape or the like is formed along a circle.

Further, any one of the above-described shapes may have several cuts at several positions on the indication lamp.

According to the fire detector having such a structure, when the cover of the top portion on the covering body for covering the fire detector is only changed, it is possible to apply for various kinds of fire detectors easily. Accordingly, it is possible to reduce the production cost for the fire detector.

Preferably, in the above-described fire detector, the indication lamp comprises a light guide member (20) for introducing the light emitted from the light source into the indication lamp with the predetermined shape.

According to the fire detector having such a structure, the light guide member introduces the light emitted from the light source to the indication lamp with the predetermined shape, to make an indication lamp. Accordingly, it is possible to observe whether the fire detector is operating or not from every direction. Further, it is possible to arrange internal parts thereof as well as one of earlier development. As a result, it is possible to preferably realize the fire detector of the present invention.

Preferably, in the above-described fire detector, the light guide member comprises a light incident part which receives the light emitted from the light source and a light emitting part which communicates with the light incident part and has an emitting surface for emitting the light from the light incident part to the outside thereof.

According to the fire detector having such a structure, the emitting surface of the light emitting part can perform the function of the indication lamp of the fire detector.

Preferably, in the above-described fire detector, the light guide member comprises a plurality of light incident parts.

When the light guide member comprises a plurality of light incident parts, light sources corresponding to the number of light incident parts may be provided. Further, only one light source may be provided so as to separate the light from the only one light source to introduce the light to each of the light incident parts.

According to the fire detector having such a structure, the amount of light which is introduced throughout the light guide member becomes larger. Accordingly, the luminance of the indication lamp increases so that it becomes easier to see the indication lamp clearly from anywhere.

Preferably, in the above-described fire detector, the light incident part is extended from the light emitting part.

Accordingly, it is possible to position the top portion of the light incident part in the vicinity of the light source.

In the above-described fire detector, when the light incidence part is extended from the light emitting part, it is possible to surface-mount the light source on the circuit board.

Accordingly, when the light source is surface-mounted on the circuit board, it is not necessary to connect the light source with the circuit board through a lead line or the like. Therefore, it is possible to decrease the number of parts and the number of assembly processes when producing it. As a result, it is possible to reduce the cost thereof.

In the above-described fire detector, the end portion which receives the light, of the light incident part may be formed so as to have a lens-like shape.

Herein, the lens-like shape includes a convex and a concave.

According to the fire detector having such a structure, the light which enters the light incident part from the light source, may be changed to an approximate parallel light through the end portion which is formed in a lens-like shape. Accordingly, it is possible to control the loss of the light which enters the light incident part, at the minimum.

In the above-described fire detector, the end portion which receives the light, of the light incident part may be formed so as to become smaller gradually toward the traveling direction of the light.

Herein, the most end portion of the light emitting part may be formed so as to have the above-described lens-like shape.

Accordingly, the light which enters the light incident part from the light source, is concentrated through the end portion of the light incident part toward the traveling direction of the light. As a result, it is possible to introduce much more light to the light emitting part.

Preferably, in above-described the fire detector, the light guide member comprises a light introducing part for introducing the light from the light incident part so that the light is transmitted through the light emitting part.

Herein, the attachment position and the structure of the light introducing part are not especially limited. The light introducing part may be disposed in either the light incident part or the light emitting part. Further, the light introducing part may be disposed so as to bridge both the light incident part and the light emitting part.

According to the fire detector having such a structure, the light from the light incident part is introduced by the light introducing part to be transmitted through the light emitting part. Accordingly, it is possible to efficiently transmit the light from the light incident part through the light emitting part.

Preferably, in the above-described fire detector, the light introducing part comprises a notch which is formed in the light emitting part.

When the notch has a simple shape such as a V-like shape or the like, it is easy to shape such a notch. Accordingly, it is possible to easily form the light introducing part.

In the above-described fire detector, at least one portion of the surface which forms the light emitting part, except of the emitting surface, may be covered with a light reflecting member for reflecting the light.

Herein, it is not necessary that the entirety of the surface which forms the light emitting part, except of the emitting surface is covered with the light reflecting member. Further, in order to cover the surface which forms the light emitting part with the light reflecting member, for example, the surface may be covered with a material for reflecting the light, a metallic or white color foil, a paint, or the like. Further, the covering body may be also used therefore.

Accordingly, the light which is emitted from the surface which forms the light emitting part, except of the emitting surface, is reflected by the light reflecting member. Thereby, the light is returned in the interior of the light emitting part. As a result, it is possible to efficiently emit the light only from the emitting surface and to provide an indication lamp which can be seen clearly from anywhere.

In the above-described fire detector, the light reflecting member may be one portion (the first reflecting surface 40, the second reflecting surface 41, and the third reflecting surface 11d) of the covering body.

Herein, when the covering body itself is made of a material which can reflect the light, it may be used as the light reflecting member, as it is. Further, the portion which performances the function of the light reflecting member, of the covering body may be applied with a foil, a paint, or the like, for reflecting the light.

Accordingly, only by incorporating the light guide member in the covering body, it is possible to cover the light emitting part with the light reflecting member. As a result, it is possible to easily realize the present invention without increasing of the number of assembly processes thereof.

In the above-described fire detector, the emitting surface may be formed so as to incline to both side and lower surfaces of the covering body.

Accordingly, because the emitting surface on the light guide member, that is, the indication lamp, is formed so as to incline to both side and lower surfaces of the covering body, when such a fire detector is attached to a ceiling, it is possible for surrounding people to see the indication lamp from just under position and from oblique under position of the fire detector. As a result, it becomes much easier to observe whether the fire detector is operating or not.

Preferably, in the above-described fire detector, a large number of micro structural parts each of which has at least either micro grooves (for example, small grooves 24, and 24 . . . ) or micro protrusions, are formed in a surface of the light emitting part.

Herein, a plurality of micro grooves and micro protrusions, as micro structural parts, may be formed as a mixture in one surface. Only a plurality of micro grooves may be formed in a surface, and only a plurality of micro protrusions may be formed in another surface. In one light guide member, either micro grooves or micro protrusions may be formed. Micro grooves or micro protrusions may not be formed in the entirety of the surface which forms the light emitting part and may be formed only in the necessary surface, as occasion demands.

According to the fire detector having such a structure, the light from the light emitting part performs complicatedly reflection and the like repeatedly by a large number of micro grooves or micro protrusions which are formed in the light emitting part. Accordingly, the luminance of light emitted from the emitting surface becomes larger so that it is possible to provide an indication lamp which can be seen more clearly.

In the above-described fire detector, the larger the length from the light incident part is, the larger the density of micro structural parts is.

Accordingly, the amount of light emitted from the whole emitting surface on the light emitting part becomes uniform. As a result, it is easy to recognize the indication lamp clearly from anywhere when the indication lamp emits the light from the light source.

Preferably, in the above-described fire detector, because the micro structural parts are formed so as to be distributed uniformly throughout the light emitting part, it looks better, especially when no light is emitted.

In the above-described fire detector, light scattering particles may be contained in an interior of the light emitting part.

Accordingly, the light in the interior of the light emitting part is more complicatedly scattered by the light scattering particles which are contained in the interior of the light emitting part. As a result, the amount of light emitted from the emitting surface becomes larger so that it becomes easier to recognize the indication lamp.

In the above-described fire detector, the larger the length from the light incident part is, the larger the number of light scattering particles contained in the interior of the light emitting part is.

Accordingly, the amount of light emitted from the whole emitting surface on the light emitting part becomes uniform. As a result, it is possible to see the lighted indication lamp clearly when the indication lamp emits the light.

In the above-described fire detector, because light scattering particles may be contained uniformly throughout the light emitting part, it looks better, especially when no light is emitted.

In the above-described fire detector, the portion near the light incident part in the light emitting part may be the thickest. Further, the larger the length from the light incident part is, the thinner the thickness thereof is.

Accordingly, the light travels in various directions through the light emitting part to be efficiently transferred throughout the light emitting part. Consequently, the light emission from the emitting surface becomes stronger and the sighted recognition from the outside thereof is improved.

Preferably, in the above-described fire detector, the emission of light by the indication lamp can be stopped.

Because the emission of light by the indication lamp can be stopped, it is possible to put a light off, for example, at a bedtime during the night, as occasion demands.

Preferably, in the above-described fire detector, the amount of light emitted from the indication lamp can be changed.

Because the amount of light emitted from the indication lamp can be changed, it is possible to reduce the amount of light to lower the light, for example, at a bedtime during the night, as occasion demands.

Herein, the amount of light emitted from the indication lamp may be changed not only by reducing the amount of light emitted from the light source but also by mechanically covering one portion of the indication lamp or the whole thereof with a semitransparent member.

Preferably, in the above-described fire detector, a plurality of light sources are provided and the number of light sources for emitting lights can be changed.

Because a plurality of light sources are provided and the number of light sources for emitting lights can be changed, it is possible to reduce the number of light source for emitting lights to reduce the amount of light, for example, at a bedtime during the night, as occasion demands.

In the above-described fire detector, in order to stop emitting the light, to change the amount of light, and change the number of light sources for emitting lights, the fire detector may be controlled by setting a central device which is connected with the fire detector, such as a fire receiving device, or by setting each fire detector individually.

In accordance with another aspect of the present invention, the fire detector (10) comprises: a covering body which comprises a body case (30) with an opening **(30*b*) formed at a center thereof and a cover (11)** for covering the opening; and an indication lamp which is formed in a ring shape.

Herein, the covering body may further comprise another part as a structural element.

According to the fire detector having such a structure, the opening is formed at the center of the body case, and the opening is covered with the cover which is a part other than the body case. Therefore, by changing the shape of the cover, it is possible to provide a covering body which can be applied for various types of fire detectors.

That is, for example, when the fire detector is a light scattering type smoke detector, a simple cover not having a special structure may be used as a cover. When the fire detector is a heat and smoke complicated type detector or a heat type detector, a cover having a shape with a space for receiving a heat sensing element therein may be used as a cover.

Accordingly, it is possible to change the type of the covering body individually, by only exchanging the cover of the covering body. Consequently, it is not necessary to design and manufacture the covering body individually for each type so that it is possible to reduce the production cost thereof.

Specially, when the indication lamp is formed in a ring shape, it is possible to observe the indication lamp from every direction. Accordingly, it is possible to provide an excellent fire detector which has the good sighted recognition and requires only the lower production cost as possible.

BRIEF DESCRIPTION OF THE DRAWINGS

The present invention will be become more fully understood from the detailed description given hereinafter and the accompanying drawings which are given by way of illustration only, and thus are not intended as a definition of the limits of the present invention, and wherein.

PREFERRED EMBODIMENT OF THE INVENTION

Figure 1A:
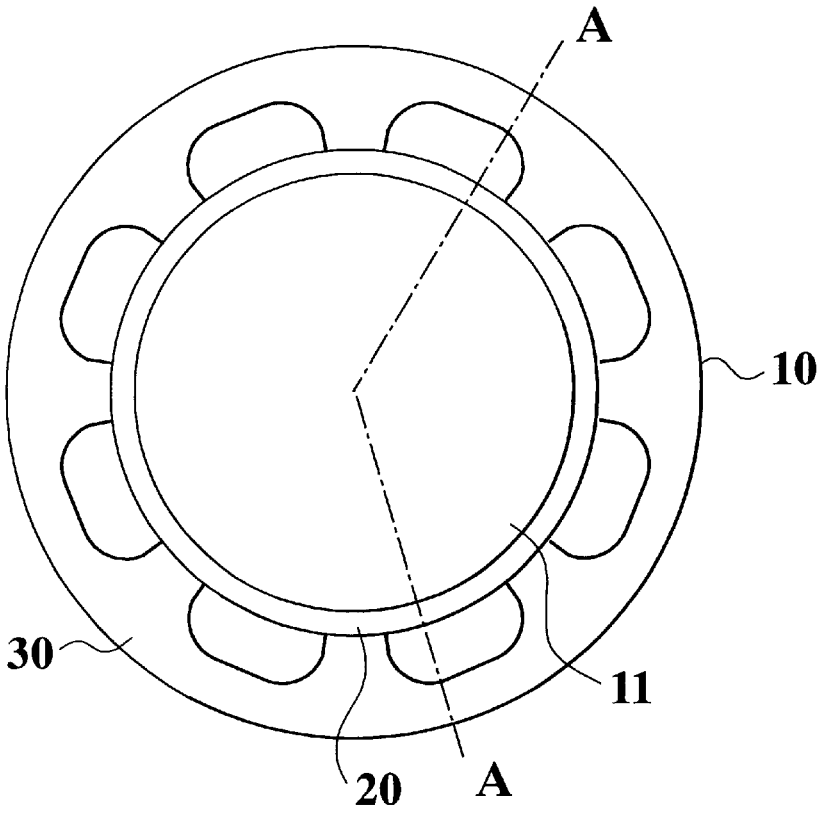
FIG. 1A is a plan view of the fire detector as an embodiment of the present invention.

First Embodiment:

Hereinafter, an embodiment of the present invention will be explained with reference to the drawing, as follows.

Figure 1B:
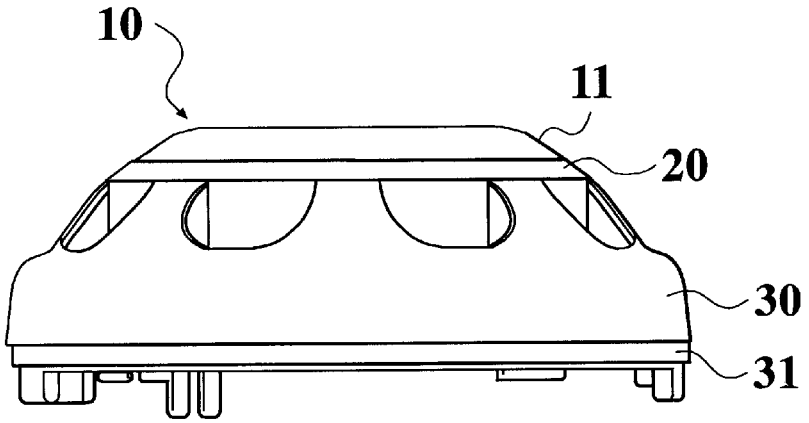
FIG. 1B is a side elevation view thereof.
Figure 2A:
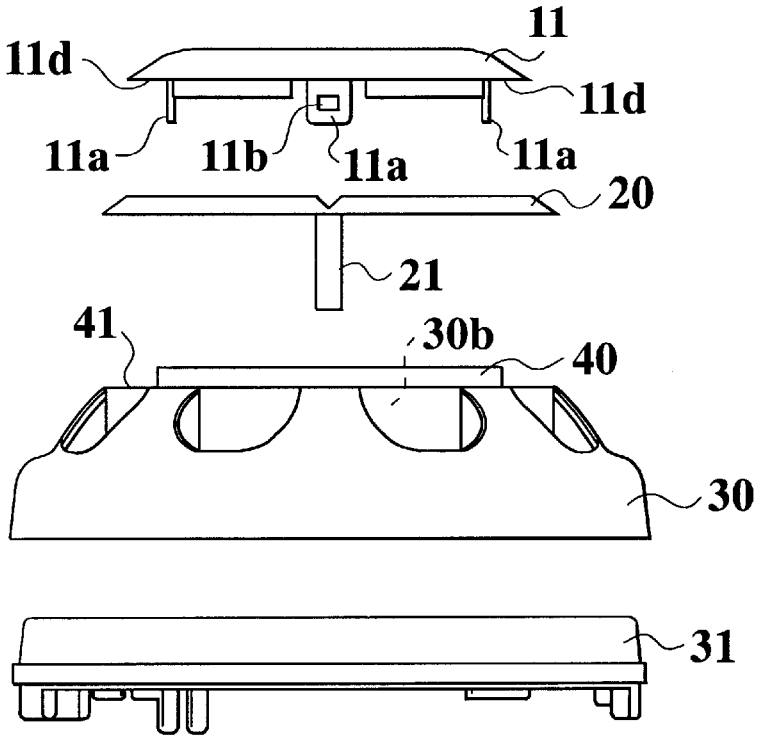
FIG. 2A is a side elevation view of each part for composing the covering body of the fire detector shown in FIGS. 1A and 1B.
Figure 2B:
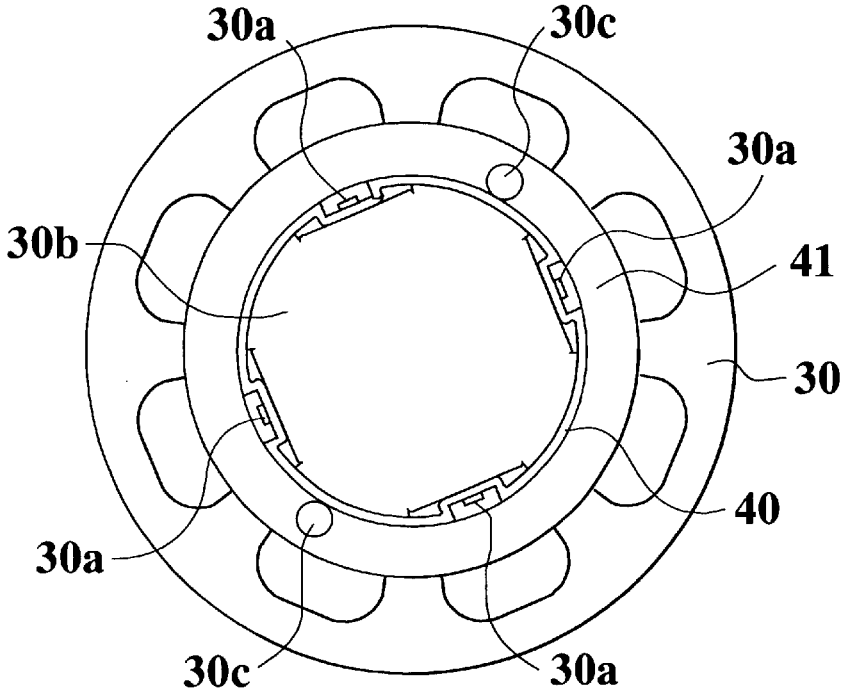
FIG. 2B is a plan view of the body case for composing the covering body.
Figure 3:
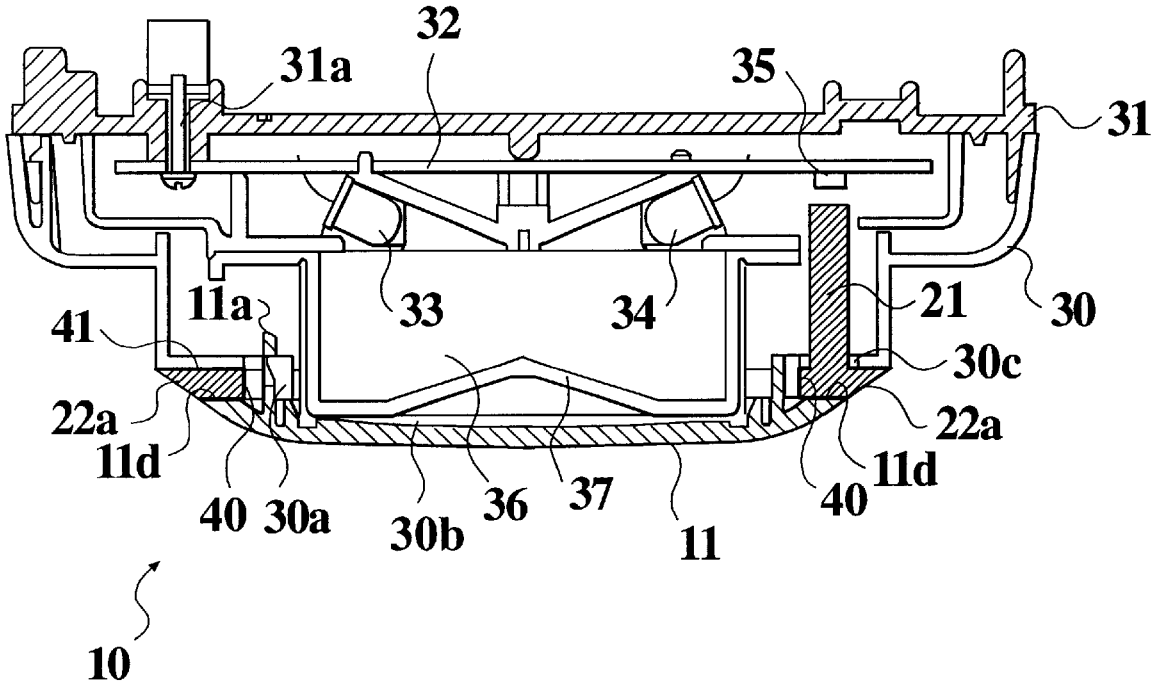
FIG. 3 is a section view of the fire detector.

FIG. 1A is a plan view showing an external appearance of the fire detector 10 as an embodiment of the present invention, and FIG. 1B is a side elevation view thereof. FIG. 2A is a side elevation view of each part in a case that parts for composing the covering body of the fire detector 10 are exploded, and FIG. 2B is a plan view of the body case. FIG. 3 is a section view of the fire detector 10 taken along the line A—A shown in FIG. 1A.

The fire detector 10 is a light scattering type smoke detector. When the fire detector 10 is attached to a ceiling of building, an upper side shown in FIG. 1B, that is, a top portion side thereof, is faced toward down.

The external portion of the fire detector 10 is composed of a cover 11, a light guide member 20, a body case 30, and a base 31, as shown in FIG. 1A to FIG. 3.

A circuit board 32 is fixed on the base 31 by a screw 31*a*, as shown in FIG. 3. A light emitting element 33 and a light detecting element 34 are mounted on the circuit board 32 through a lead line. Two light emitting diodes (LED) 35, although only one of two light emitting diodes 35 is shown in FIG. 3, as a light source of the present invention are surface-mounted on the circuit board 32.

The body case 30 is made of white resin. The body case 30 is a ring member in the plan view thereof. A circular opening 30*b* is formed at the center of the body case 30. A smoke detecting box 37 is provided in the interior of the body case 30 to form a smoke detecting room 36. Further, the circuit board 32, the light emitting element 33, and the light detecting element 34 which are attached to the base 31, are faced to the inside of the body case 30.

According to the fire detector 10, when a smoke is occurred by fire or the like, the smoke occurred by fire flows into the smoke detecting room 36. While the fire detector 10 is operating, the light emitted from the light emitting element 33 is scattered by the smoke flowed in the smoke detecting room 36. The light scattered by the smoke is detected by the light detecting element 34. Therefore, the fire is detected. Further, while the fire detector 10 is operating, the LED 35 emits the light for indicating the fire detector 10 being under detection.

Four pawls 30*a* for engaging the cover 11, are formed in the vicinity of the opening 30*b* in the interior of the body case 30. Only one pawl 30*a* of four pawls is shown in FIG. 3.

As shown in FIGS. 2A and 2B, a circular thin plate is disposed in a standing position, in a circumference of the opening 30*b*. An outer surface of the thin plate is contacted with an inner surface 22*b* of a ring member 22 on the light guide member 20. Therefore, the outer surface of the thin plate performs the function of the first reflecting surface 40 which is a light reflecting member, for reflecting a light emitted from the inner surface 22*b*.

A surface is extended from the first reflecting surface 40 radially with a predetermined wide. Thereby, a flat surface is formed in a ring shape in the plane view thereof. The flat surface is contacted with a bottom surface 22*d* of the ring member 22. Therefore, the flat surface performs the function of the second reflecting surface 41 which is the light reflecting member, for reflecting a light emitted from the bottom surface 22*d*.

Two interfit holes 30*c* which face each other, are formed on the second reflecting surface 41, in order to interfit the light incident parts 21 and 21 of the light guide member 20 into two interfit holes 30*c*, respectively. Only one interfit hole 30*c* is shown in FIG. 3.

Figure 4A:
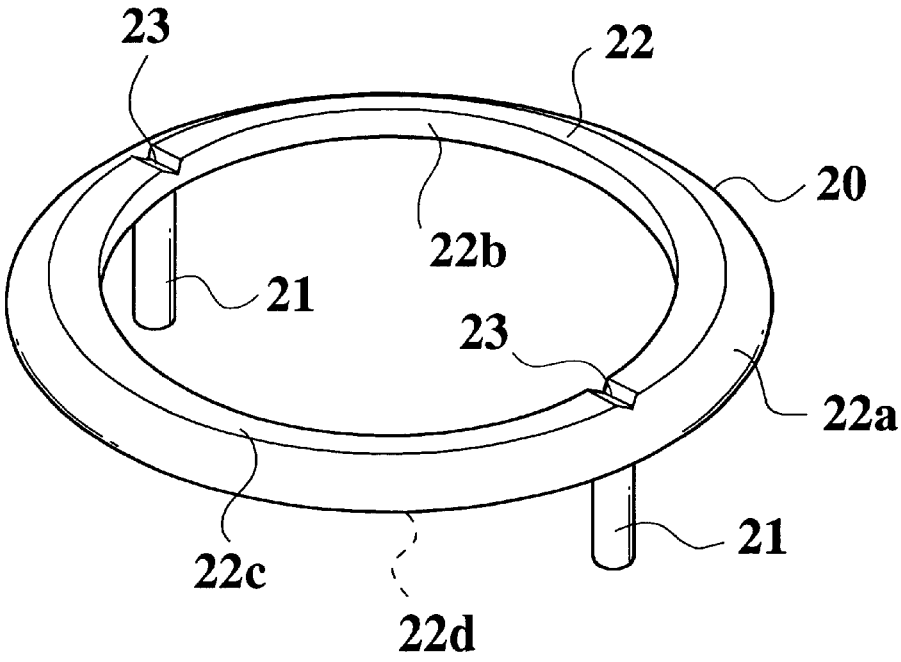
FIG. 4A is a perspective view of the light guide member used in the fire detector.
Figure 4B:
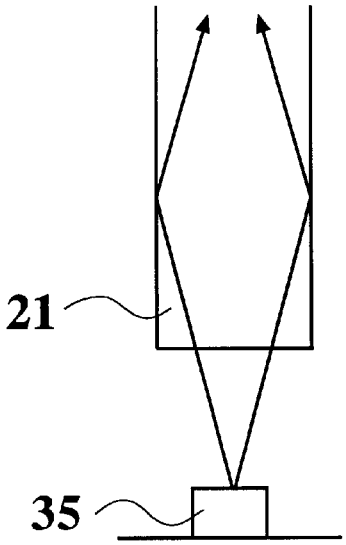
FIG. 4B is an enlarged view of one portion on the light incident part of the light guide member.
Figure 5:
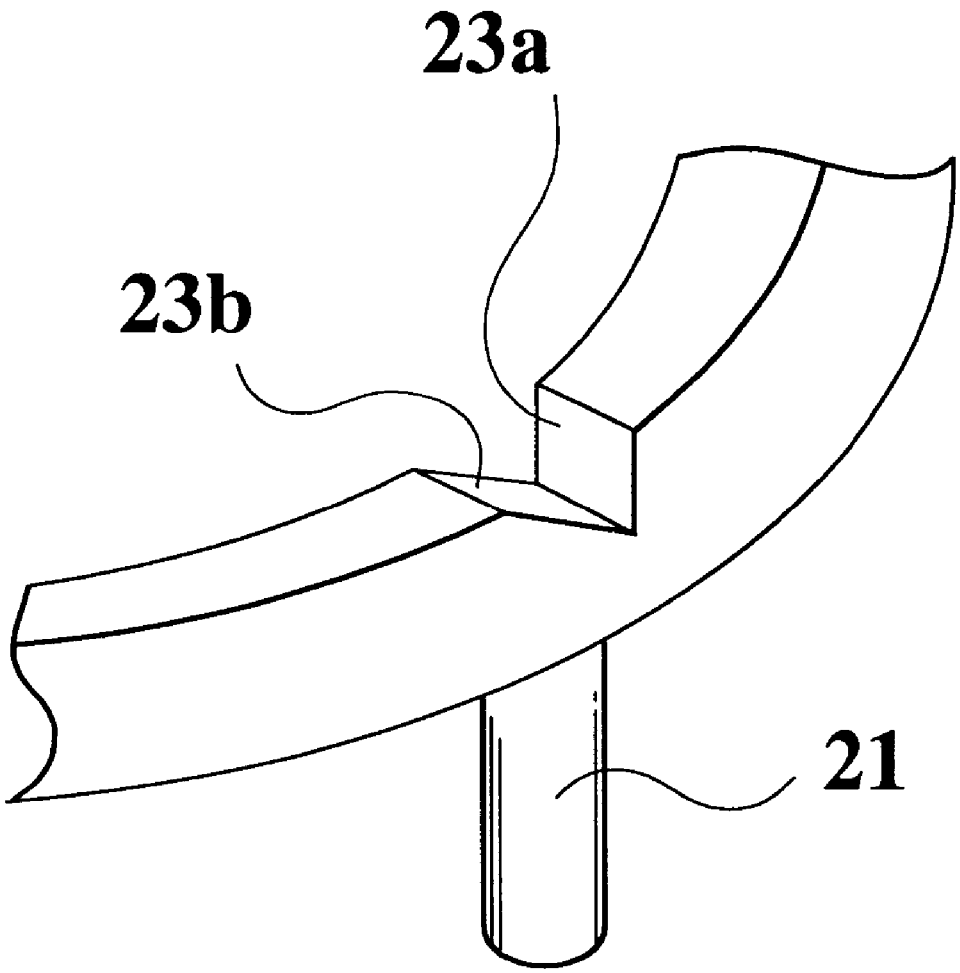
FIG. 5 is a perspective view showing the notch having the different shape from one shown in FIG. 4A.
Figure 6C:
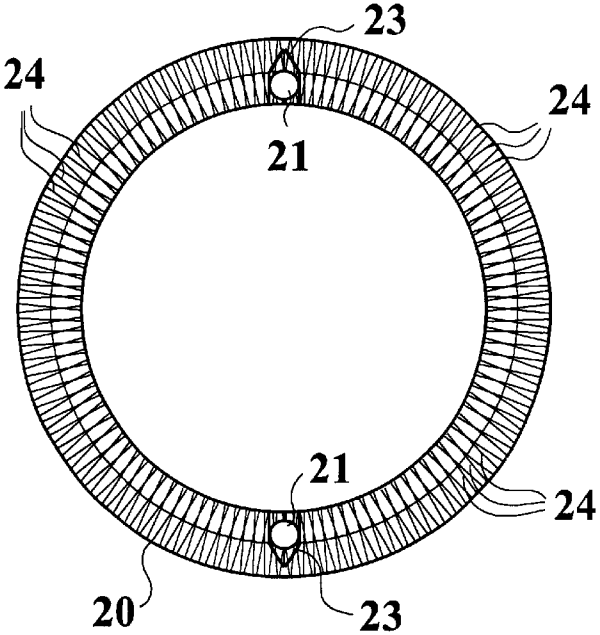
FIG. 6C is a bottom view thereof.
Figure 6A:
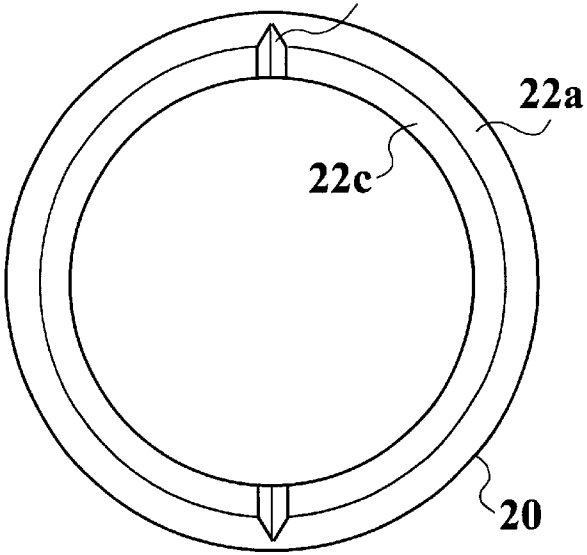
FIG. 6A is a plan view of the light guide member shown in FIG. 4A.
Figure 6B:
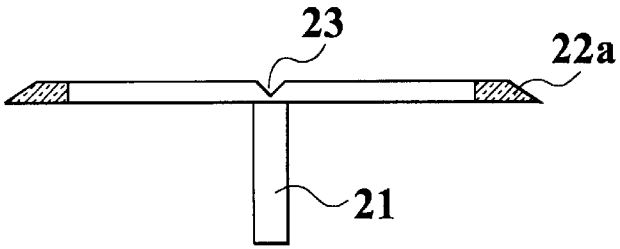
FIG. 6B is a section view thereof.

FIG. 4A is a perspective view of the light guide member, and FIG. 4B is an enlarged view of one portion on the light incident part of the light guide member. FIG. 5 is a perspective view showing the notch having the different shape from one shown in FIG. 4A. FIG. 6A is a plan view of the light guide member shown in FIG. 4A, FIG. 6B is a section view thereof, and FIG. 6C is a bottom view thereof.

The light guide member 20 is composed of the ring member 22 which is formed in a ring shape and which is a light emitting part, and the light incident parts 21 and 21 which are formed in a stick-like shape and which are extended from the ring member 22 toward down. The ring member 22 and the light incident parts 21 and 21 are made of material which can transmit the light.

According to each of light incident parts 21 and 21, the light emitted from the LED 35 enters each light incident part 21 from each end portion thereof. The end portion of light incidence part 21 is formed in a flat, as shown in FIG. 4B. The light which enters the light incident part 21 travels toward the ring member 22.

The ring member 22 is composed of an emitting surface 22*a* which is a surface for reflecting the light to the outside thereof when the light guide member 20 is incorporated in the fire detector and which does its duty as an indication lamp, the inner surface 22*b*, the upper surface 22c, and the bottom surface 22*d*. The emitting surface 22*a* is formed in an inclined surface between the upper surface 22*c* and the bottom surface 22*d*.

Notches 23 and 23 are formed in a V-like shape, at the ring member 22 on the upper of the light incident parts 21 and 21, as shown in FIG. 4A or FIG. 6B. The light from the light incident parts 21 and 21 is sent out to the ring member 22 by reflecting at the inclined surface on the notches 23 and 23. That is, each of the notches 23 and 23 performs the function of the light introducing part in the present invention.

Two surfaces which form each of notches 23 and 23, may be formed so as to have approximately the same predetermined angle against the parallel line in the length direction of each of the light incident parts 21 and 21, as shown in FIG. 4A or FIG. 6B. One surfaces 23*a* may be formed so as to be almost parallel to the parallel line in the length direction of the light incident part 21, and the other surface 23*b* may be formed so as to have the predetermined angle against the parallel line, as shown in FIG. 5.

A plurality of small grooves 24, 24, and 24 . . . which are micro small grooves formed in an uniform hair line and micro structural parts, are formed in the bottom surface 22*d* of the ring member 22, as shown in FIG. 6C. The light of the interior of the ring member 22 reflects in various directions by small grooves 24, and 24 . . .

Light incident parts 21 and 21 of the light guide member 20 are interfitted into two interfit holes 30*c* of the body case 30, respectively, as shown in FIG. 3. The light guide member 20 is pressed by the cover 11 which will be explained as follows, to be incorporated in the fire detector 10.

End portions of the light incident parts 21 and 21 which are interfitted into two interfit holes 30*c* are positioned in the vicinity of two LED 35 on the circuit board 32, respectively, as shown in FIG.3. Thereby, the light emitted from each LED 35 enters the interior of each the light incident part 21.

When the light guide member 20 is incorporated in the fire detector 10, the inner surface 22*b* of the ring member 22 is contacted with the first reflecting surface 40 on the body case 30, the bottom surface 22*d* of the ring member 22 is contacted with the second reflecting surface 41, and the upper surface 22*c* of the ring member 22 is contacted with the third reflecting surface 11*d* which will be explained as follows, respectively. Thereby, lights which are emitted from the inner surface 22*b*, the bottom surface 22*d*, and the upper surface 22*c*, to the outsides thereof, are reflected by the first reflecting surface 40 with a white color, the second reflecting surface 41 with a white color, and the third reflecting surface 11*d* with a white color, respectively. Thereafter, they are returned in the interior of the ring member 22.

In FIG. 3, the portion which is contacted with the body case 30 and the cover 11, of the light guide member 20, is shown by a thick line.

The emitting surface 22*a* on the ring member 22 is formed so as to incline to the upper surface 22*c* and the bottom 22*d*. Therefore, in a state of setting the light guide member 20 at the fire detector 10 as shown in FIG. 3, the emitting surface 22*a* is the inclined surface which is formed so as to incline to both side and bottom surfaces of the detector 10.

The cover 11 is made of white resin and formed in a shape which can be looked like an approximate disc-like shape from the upper and the lower direction, as shown in FIG. 1A.

An engaging portion 11*a* has a hole 11*b*, as shown in FIG. 2A. Four engaging portions 11*a* are formed with approximately the same intervals along a circle which is formed with the predetermined radius from the center thereof, on a rear side of the cover 11.

A flat surface is formed in a ring shape at the circumferential portion on the rear side of the cover 11. The surface is contacted with the upper surface 22*c* of the above-described ring member 22 to perform the function of the third reflecting surface 11*d* for reflecting the light emitted from the upper surface 22*c*.

The light incident parts 21 and 21 of the light guide member 20 are interfitted into the interfit holes 30*c* and 30*c* of the body case 30, respectively. In this state, each of four engaging portions 11*a* on the cover 11 is hung on each of four pawls 30*a* on the body case 30, respectively, so that the cover 11 covers the light guide member 20. Thereby, the cover 11 is fixed against the body case 30, as shown in FIG. 3. Further, the light guide member 20 is also fixed between the body case 30 and the cover 11. In this state, the third reflecting surface 11*d* is contacted with the upper surface 22*c* on the ring member 22 of the light guide member 20.

Figure 7:
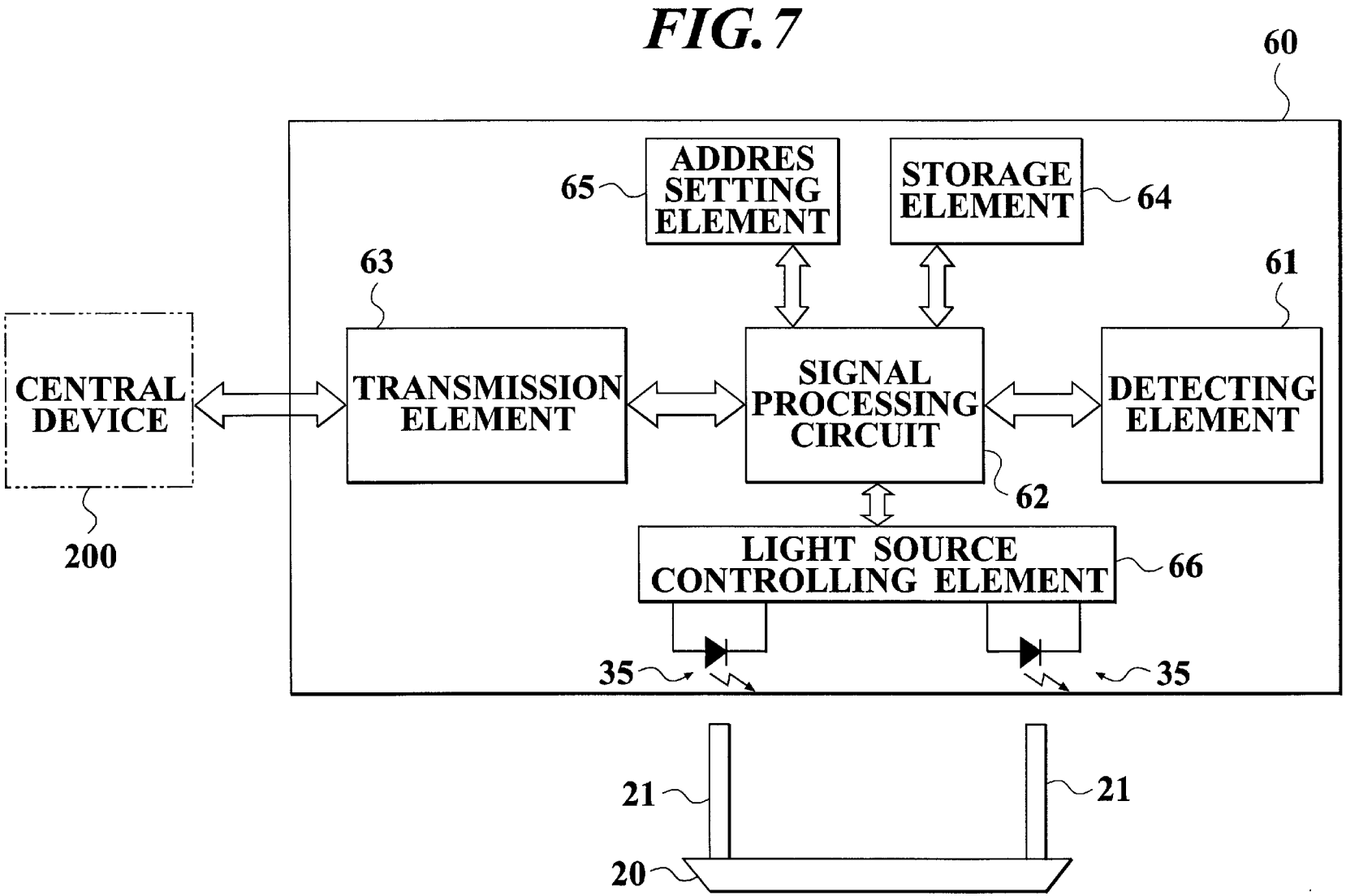
FIG. 7 is a block diagram showing the control circuit provided on the circuit board of the fire detector.

FIG. 7 shows a schematic view of the control circuit 60 formed on the circuit board 32. The control circuit 60 is composed of a detecting element 61, a signal processing circuit 62, a transmission element 63, a storage element 64, an address setting element 65, and a light source controlling element 66.

When the fire detector 10 is attached to a ceiling of building or the like, the fire detector 10 is connected with a central device 200 such as a fire receiving device or the like, through the transmission element 63. Thereby, the fire detector 10 is controlled by the central device 200, to operate.

Further, a plurality of fire detectors 10 and another terminal device are connected with the central device 200. Each fire detector 10 is discriminated by the individual address set at the address setting element 65.

The detecting element 61 comprises the light emitting element 33 and the light detecting element 34.

The light emitting element 33 is emitted the light every the predetermined time by the detecting element 61. When the light detecting element 34 detects the light emitted by the light emitting element 33 to output the light detecting signal, the detecting element 61 detects the light detecting signal outputted by the light detecting element 34 to output it to the signal processing circuit 62.

The signal processing circuit 62 receives the signal from and outputs the signal to the central device 200, through the transmission element 63.

According to the calling including the address from the central device 200, the signal processing circuit 62 detects whether the address outputted from the central device 200 agrees with the individual address set at the address setting element 65 or not. When the address outputted from the central device 200 agrees with the individual address set at the address setting element 65, the signal processing circuit 62 sends the light detecting signal detected by the detecting element 61 to the central device 200, or carries out the control according to the control signal sent from the central device 200.

For example, every when the individual address of the fire detector 10 is called by the central device 200, the signal processing circuit 62 makes LED 35 and 35 emit lights through the light source controlling element 66. Further, when the signal for instructing to change the amount of light emitted from LED 35 and 35 or to stop emitting the light, is inputted to the signal processing circuit 62, the signal processing circuit 62 outputs the LED control signal corresponding to the signal to the light source controlling element 66.

The light source controlling element 66 is a circuit for directly controlling LED 35 and 35. According to the signal outputted from the signal processing circuit 62, the light source controlling element 66 usually makes LED 35 and 35 periodically emit lights by the predetermined amount of light, that is called a current-carrying indication. When the LED control signal is inputted to the light source controlling element 66, the light source controlling element 66 changes the amount of light emitted from LED 35 and 35 or stops emitting the light.

The storage element 64 is a memory for memorizing data to be necessary when the signal processing circuit 62 carries out each kind of processes.

As described above, the emitting state of LED 35 and 35 of the fire detector 10 is controlled by the central device 200. The control of the emitting state of LED 35 and 35 will be explained, as follows.

The first controlling method is one for stopping the current-carrying indication by setting. In this case, the central device 200 is performed the function for setting and registering the address of the fire detector to be stopped the current-carrying indication thereof and the performance time for stopping the current-carrying indication.

For example, the fire detector having the specific address is set so as to stop the current-carrying indication thereof from the predetermined time which is a stopping time, at night to the predetermined time which is a starting time, in the morning.

When the central device 200 calls the specific fire detector 10 which is set and registered, at the stopping time, the central device 200 sends the control signal for stopping the current-carrying indication thereof to the fire detector 10.

When the fire detector 10 receives the control signal, the fire detector 10 is memorized so as not to emit lights from LED 35 and 35 when the fire detector 10 is called by the central device 200, in the storage element 64. From this, when the fire detector 10 is called by the central device 200, the fire detector does not carry out the current-carrying indication.

When the central device 200 calls the fire detector 10 at the starting time, the central device 200 sends the control signal for starting the current-carrying indication thereof to the fire detector 10.

When the fire detector 10 receives the control signal, the fire detector 10 is memorized so as to emit lights from LED 35 and 35 every when the fire detector 10 is called by the central device 200, in the storage element 64. From this, the fire detector 10 carries out the current-carrying indication.

The second controlling method is one for reducing an amount of light emitted from LED 35 and 35. In this case, the central device 200 is performed the function for setting and registering the address of the fire detector to be reduced the amount of light emitted from LED 35 and 35 and the performance time for reducing the amount of light emitted from LED 35 and 35.

The central device 200 sends the control signal for reducing the amount of light emitted from LED 35 and 35, to the fire detector 10 which is set and registered, at the predetermined time.

When the fire detector 10 receives the control signal, the fire detector 10 is memorized so as to emit lights from LED 35 and 35 by the less amount of light than usual when the fire detector 10 is called by the central device 200, in the storage element 64. From this, when the fire detector 10 is called by the central device 200, the fire detector 10 emits lights from LED 35 and 35 by the less amount of light than usual.

When the central device 200 calls the fire detector 10 at the predetermined time in the morning, the central device 200 sends the control signal for emitting the light by usual amount of light to the fire detector 10.

When the fire detector 10 receives the control signal, the fire detector 10 is memorized so as to emit the light by usual amount of light every when the fire detector 10 is called by the central device 200, in the storage element 64. From this, the fire detector 10 carries out the current-carrying indication.

Herein, in order to reduce the amount of light emitted from LED 35 and 35, the driving current thereof may be reduced.

The third controlling method is one for emitting the light from either LED 35 or 35. In this case, the central device 200 is performed the function for setting and registering the address of the fire detector to be emitted the light from either LED 35 or 35 and the performance time thereof.

The central device 200 sends the control signal for emitting the light from either LED 35 or 35, to the fire detector 10 which is set and registered, at the predetermined time.

When the fire detector 10 receives the control signal, the fire detector 10 is memorized so as to emit the light from either LED 35 or 35 every when the fire detector 10 is called by the central device 200, in the storage element 64. From this, the fire detector 10 emits the light from either LED 35 or 35.

When the central device 200 calls the fire detector 10 at the predetermined time in the morning, the central device 200 sends the control signal for usually emitting lights from two LED 35 to the fire detector 10.

When the fire detector 10 receives the control signal, the fire detector 10 is memorized so as to emit lights from two LED 35 to carry out the current-carrying indication every when the fire detector 10 is called by the central device 200, in the storage element 64. From this, the fire detector 10 carries out the current-carrying indication.

The fire detector 10 may be controlled the emission of light not only by any one method of the first, the second, and the third methods but also by a plurality of methods. For example, the fire detector 10 may be controlled so as to emit the light from one LED 35 and to reduce the amount of light thereof.

According to the above-described fire detector 10, lights emitted from two LED 35 are introduced by the light guide member 20 to be emitted from the emitting surface 22*a* which is the ring indication lamp. Accordingly, it is possible to observe whether the fire detector 10 is operating or not from every direction.

The notches 23 and 23 having V-like shape, are formed in the ring member 22 of the light guide member 20. Accordingly, it is possible to efficiently introduce the light from the light incident parts 21 and 21 to the ring member 22.

A plurality of small grooves 24, and 24 . . . are formed in the bottom surface 22*d* of the ring member 22. Accordingly, the light in the interior of the ring member 22 performs more complicatedly reflection and the like repeatedly so that the amount of light emitted from the reflecting surface 22*a* becomes larger. As a result, it is possible to provide an indication lamp having an enough luminance to see clearly.

The light guide member 20 is incorporated in the body case 30 and the cover 11. Thereby, the ring member 22 is surrounded by the first reflecting surface 40 of the body case 30, the second reflecting surface 41 of the body case 30, and the third reflecting surface 11*d* of the cover 11. Therefore, the light which is emitted from the surface except of the reflecting surface 22*a* is reflected at the first to third reflecting surfaces to be returned in the interior of the ring member 22. Accordingly, it is possible to efficiently emit the light only from the reflecting surface 22*a* and to provide an indication lamp which can be easily observed. As a result, when the arrangement of internal parts is the same to conventional one, it is possible to provide an indication lamp having an enough luminance to observe the operating state of the indication lamp from any direction of surroundings.

The light incident parts 21 and 21 are sticks which are extend from the ring member 22 so that two LED 35 may be surface-mounted on the circuit board 32. Accordingly, it is not necessary to connect the LED 35 with the circuit board 32 through a lead line or the like. As a result, it is possible to reduce the number of parts and the number of assembly processes when producing it so that it is possible to reduce the production cost thereof.

The emitting surface 22*a* as the indication lamp is the inclined surface to the side and the lower surfaces of the fire detector 10. Accordingly, when the fire detector 10 is attached to a ceiling, it is possible for surrounding people to see the indication lamp from just under and from oblique under of the fire detector 10. As a result, it becomes much easier to observe whether the fire detector is operating or not.

Although the light guide member 20 is made of just material which can transmit the light in the above-described embodiment, the light guide member 20 may be made of transparent material which is contained light scattering particles.

The above-described fire detector 10 of the present invention has the high sighted recognition in that the fire detector 10 has enough brightness and can be observed from every direction, as a main effect. However, when the indication lamp of the fire detector 10 is used for carrying out the current-carrying indication, it may give an anxiety to a person who is in a room at a bedtime during the night or the like or prevent the person from sleeping.

However, according to the fire detector 10, by setting the central device 200, it is possible to stop emitting lights from LED 35 and 35, to reduce the amount of light emitted from LED 35 and 35, and to reduce the luminance of the indication lamp by emitting the light from only one LED 35. Accordingly, it is possible to control the indication lamp for carrying out the current-carrying indication, so as to be the appropriate state at a bedtime during the night.

Grooves which are formed in a hair line shape in the light guide member 20, are not limited to be formed in the bottom surface of the ring member 22. The grooves may be formed in the bottom surface, the upper surface, the inner surface, or the reflecting surface, of the ring member 22, as occasion demands.

Grooves which are formed in a hair line shape, are not limited to be formed in the pattern as shown in FIG. 6C. The grooves may be formed so as to be able to efficiently emit the light to the outside thereof. For example, the grooves may be formed in the pattern as shown in FIG. 8 which will be explained as follows.

Figure 8:
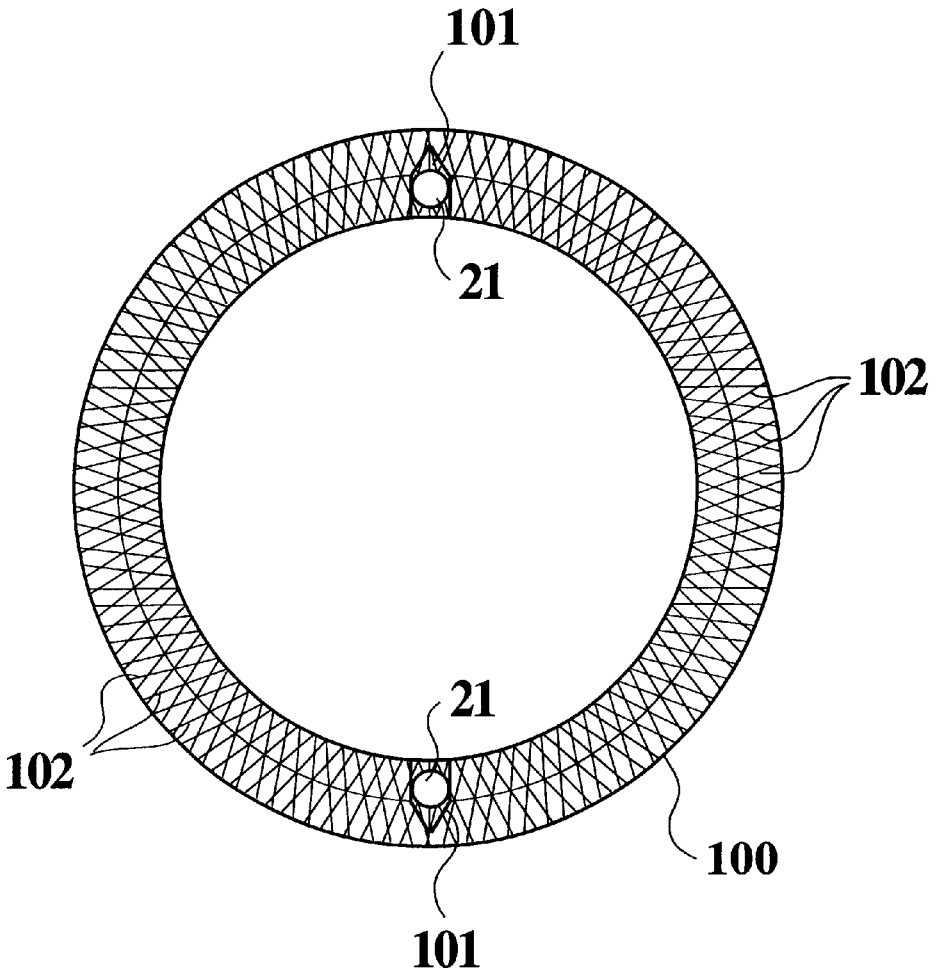
FIG. 8 is a bottom view showing another embodiment of micro structural part which is formed at the light guide member of the present invention.

FIG. 8 shows an embodiment of the light guide member used in the present invention. Notches 101 and 101 are formed in the light guide member 100, as well as that notches 23 and 23 are formed in the light guide member 20. A plurality of grooves 102, 102, and 102 . . . are formed in a hair line shape in the surface of the light guide member 100, so as to cross each other more often than a case of that a plurality of grooves 24, 24, and 24 . . . are formed in the light guide member 20.

The light introducing part of the light guide member is not limited to have the groove as the above-described embodiment. The light introducing part of the light guide member may have the protrusion as shown in FIG. 9.

Figure 9:
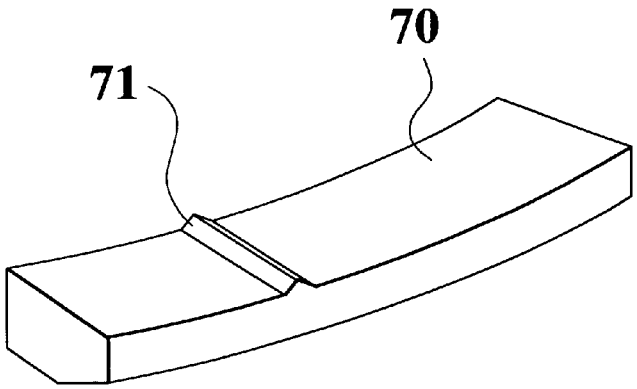
FIG. 9 is a perspective view showing a protrusion as the light introducing part which is formed at the light guide member of the present invention.

FIG. 9 shows only one portion of the light guide member 70 as another embodiment of the light guide member of the present invention. That is, on the light incident part which is not shown in figures, of the light guide member 70 as shown in FIG. 9, a protrusion 71 is formed in a mountainous shape. Therefore, the light from the light incident part is reflected by the inclined surface of the protrusion 71.

The end portion of the light incident part 21 on the light guide member 20 is formed in a flat surface as shown in FIG. 4B. However, the end portion of the light incident part 21 is not limited to this shape in the present invention.

For example, the end portion of the light incident part 21 may be formed in such a shape like a convex lens or a concave lens.

Figure 10A:
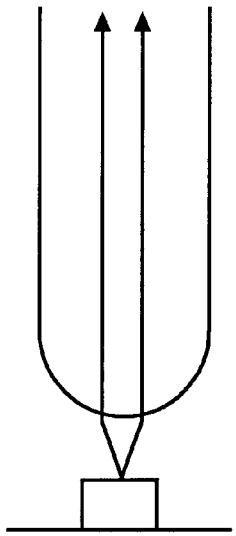
FIG. 10A and FIG. 10B are views for explaining a variation of shape of an end portion of the light incident part on the light guide member.
Figure 10B:
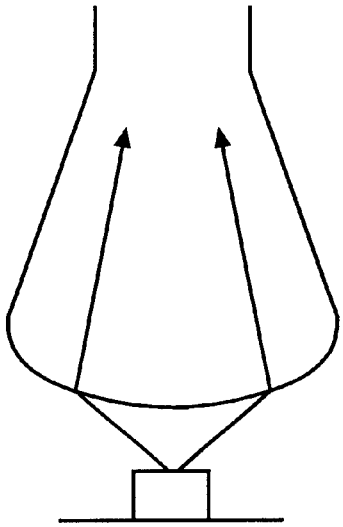

FIG. 10A and FIG. 10B are views for explaining various types of shapes of the end portion of the light incident part on the light guide member.

FIG. 10A shows a case that the end portion of the light incident part is formed in such a shape like a convex lens. When the end portion of the light incident part is formed in such a shape like a convex lens or a concave lens, it is possible that the light which enters the end portion of the incident part from the light source is changed to a parallel light. Further, it is possible to control the amount of light loss on the light incident part as possible.

Further, FIG. 10B shows a case that the end portion of the light incident part is formed so as to become smaller gradually toward the travelling direction from the end portion of the light incident part. When the end portion of the light incident part is formed so as to become smaller gradually toward the travelling direction from the end portion of the light incident part, it is possible to gather the light from the light source. Further, it is possible to efficiently transfer the light from the light source. Although the shape of the most end portion has the convex surface in FIG. 10B, the most end portion may be formed in a concave surface or a plan.

The shape of the light guide member 20 is not limited to the above-described embodiment.

Figure 11A:
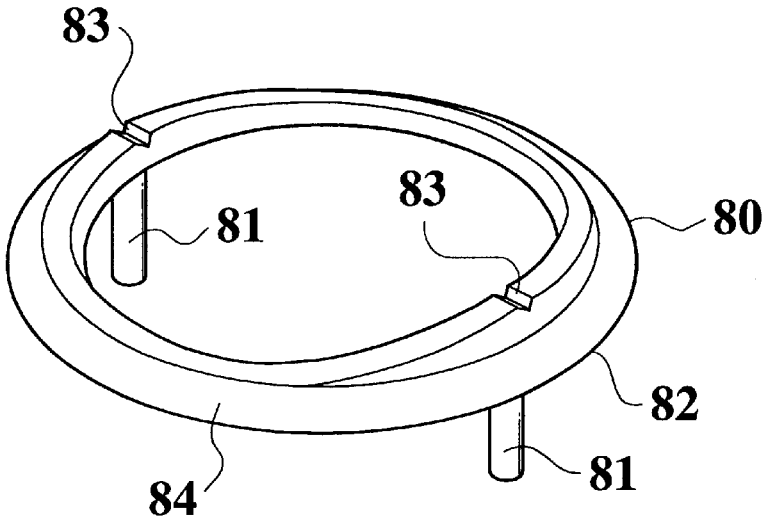
FIG. 11A is a perspective view showing another embodiment of the light guide member of the present invention.
Figure 11B:
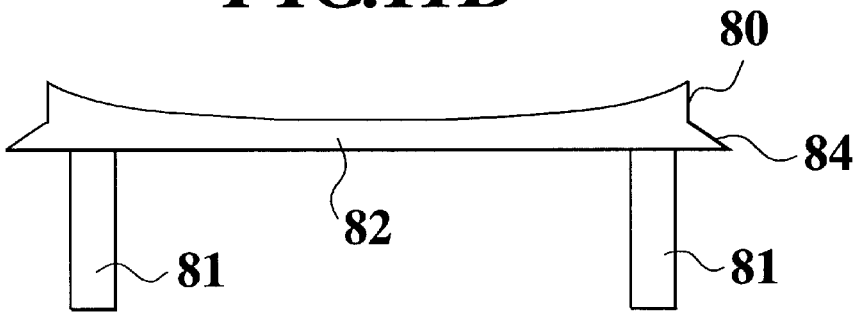
FIG. 11B is a side elevation view thereof.
Figure 11C:
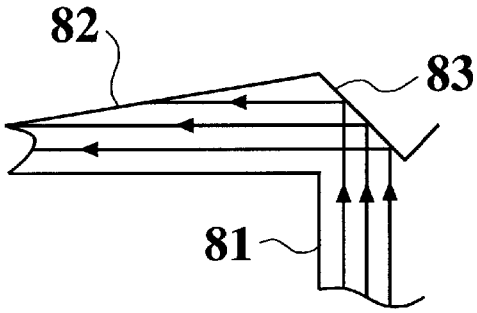
FIG. 11C is a view showing the transmission state of a light.

FIG. 11A, FIG. 11B, and FIG. 11C shows another embodiment of the light guide member of the present invention. FIG. 11A is a perspective view of the light guide member as another embodiment. FIG. 11B is a side elevation view of the light guide member shown in FIG. 11A. FIG. 11C is a view showing the transmission state of the light.

As shown in FIG. 11A and FIG. 11B, the light guide member 80 is made of transparent material as well as one of the light guide member 20. Further, the light guide member 80 is composed of light incident parts 81 and 81 and a ring member 82. An emitting surface 84 for emitting the light to the outside thereof, is formed at the ring member 82. Notches 83 and 83 having V-like shapes are formed in upper portions of the light incident parts 81 and 81, respectively. Further, grooves or protrusions may be formed in a hair line in the light guide member 80, as occasion demands.

As shown in FIG. 11B, the ring member 82 of the light guide member 80 is formed so as to be the thickest at the position of the light incident parts 81 and 81 portions. Further, the larger the length from each of the light incident parts 81 and 81 is, the thinner the thickness of the ring member 82 is.

As shown in FIG. 1C, the light which enters the light incident part 81 of the light guide member 80, is reflected at the inclined surface of the notch 83, to travel through the ring member 82. The light which travels through the ring member 82 which becomes thinner gradually, is reflected at the different position on the upper surface which is formed in the inclined surface, of the light ring member 82, according to the position at which the light is reflected, of the notch 83. Thereby, each light travels on the different course. Therefore, lights travel in the various travelling directions through the interior of the ring member 82 so that lights are efficiently transmitted throughout the ring member 82. Accordingly, the emission of light from the emitting surface 84 becomes stronger and the sighted recognition from the outside thereof is improved.

And others, the shape of the light guide member is not limited to the above-described embodiment.

For example, the light guide member may have one light incident part or a plurality of light incident parts.

The emitting surface which is the indication lamp, for emitting the light from the ring member to the outside thereof, may be not just a circle and may have such a shape like a star or flower having a plurality of bending portions.

Further, the emitting surface of the light guide member is not limited to the above-described ring shape. The emitting surface of the light guide member may be formed in such a plate-like shape like a disc-like shape or an approximately polygonal shape, or the like. The emitting surface of the light guide member may be formed in the shape so that the indication lamp can be observed when the fire detector attached to a ceiling is seen from any direction clearly.

Further, the indication lamp of the present invention may not be composed of only one part as the light guide member but also a plurality of parts.

Although the first to the third reflecting surfaces of the body case 30 and the cover li perform the function of the light reflecting surface in the above-described embodiment, the present invention is not limited to this.

The surface except of the emitting surface on the light guide member may be covered with a white paint, a metallic foil, a metallic paint, or the like, as the light reflecting member.

Although the central device 200 is preformed the function for setting and registering the fire detector for controlling the light emitting state of the indication lamp and the performance time thereof in the above-described, the individual fire detector 10 may be able to be performed the function.

Further, in accordance with the attachment position of the fire detector, the fire detector may be set so as to be always stopped emitting the light by the indication lamp thereof or reduced the amount of light without setting the performance time.

Second Embodiment:

FIG. 12A, FIG. 12B, FIG. 12C, and FIG. 13 show a modified embodiment of the above-described embodiment.

Figure 12C:
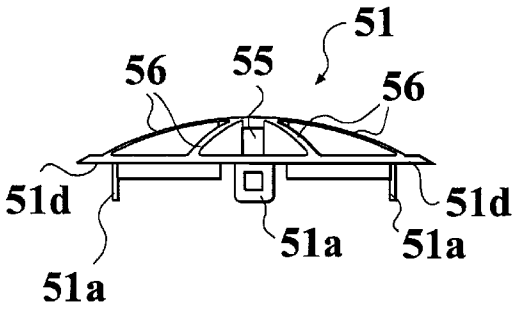
FIG. 12C is a side elevation view of the cover thereof.
Figure 12A:
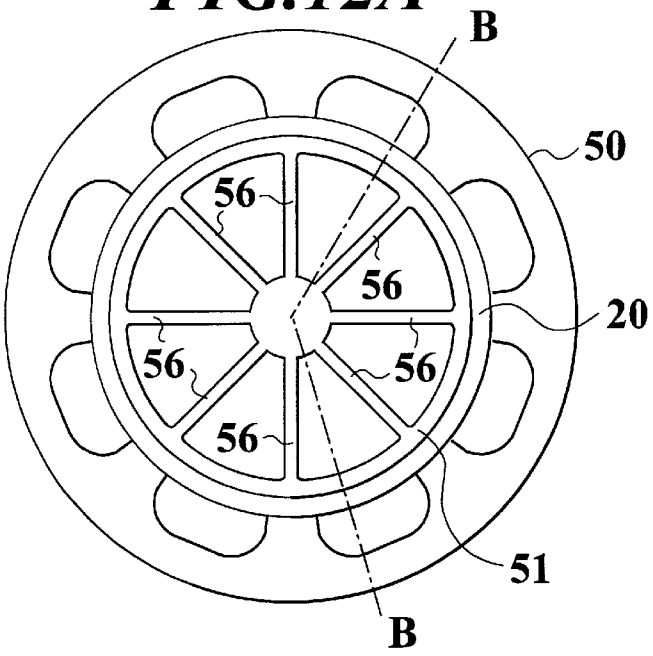
FIG. 12A is a plan view showing another embodiment of the fire detector of the present invention.
Figure 12B:
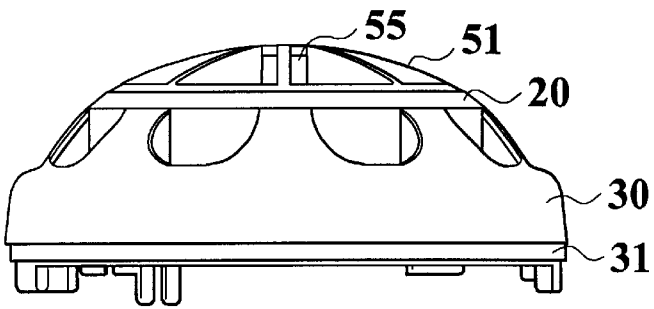
FIG. 12B is a side elevation view thereof.
Figure 13:
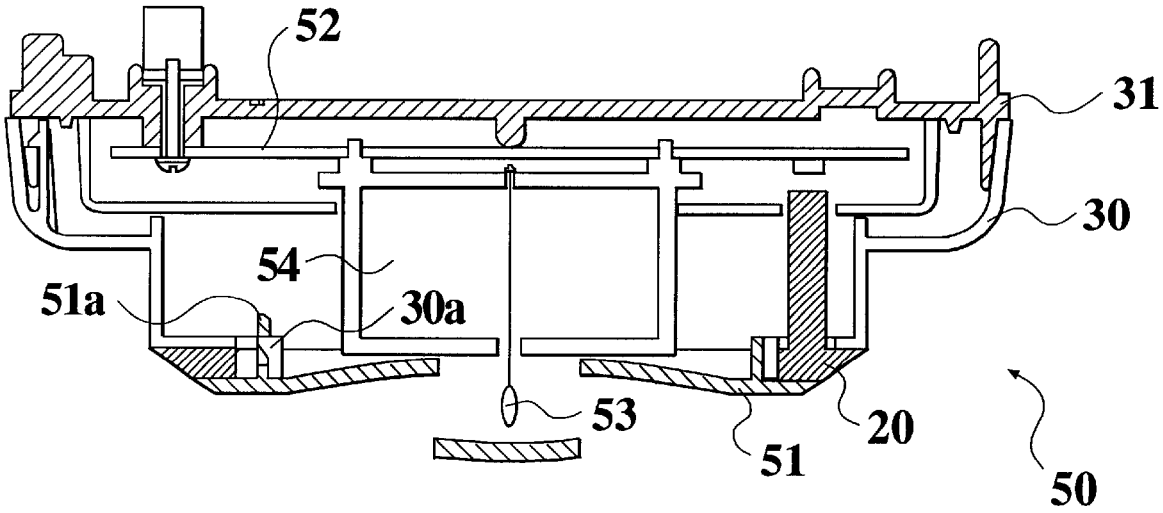
FIG. 13 is a section view of the fire detector taken along the line B—B shown in FIG. 12A.
Figure 14A:
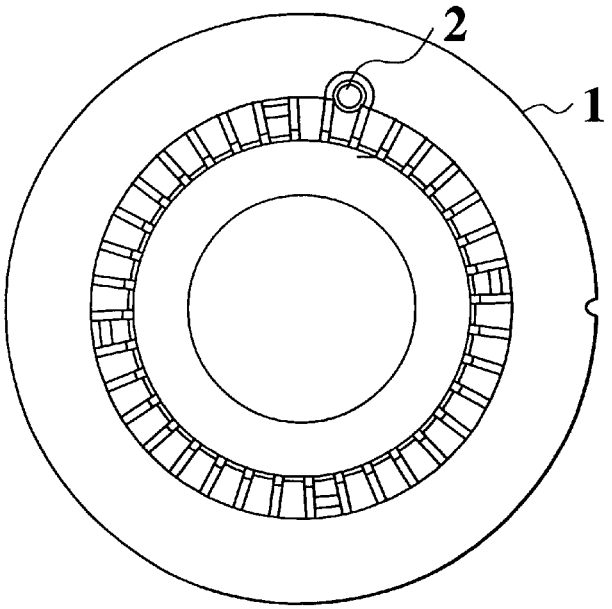
FIG.14A PRIOR ART
FIG. 14A is a plan view showing an embodiment of a conventional fire detector.
Figure 14B:
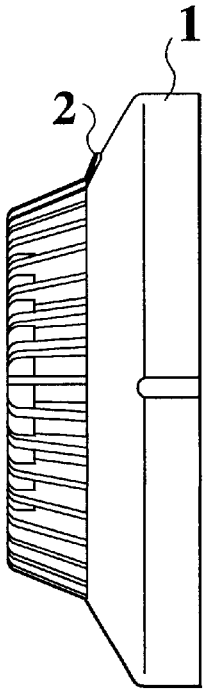
FIG.14B PRIOR ART
FIG. 14B is a side elevation view thereof.

FIG. 12A is a plan view showing another embodiment of the fire detector of the present invention. FIG. 12B is a side elevation view of the fire detector as shown in FIG. 12A. FIG. 12C is a side elevation view of the cover of the fire detector as shown in FIG. 12A. FIG. 13 is a section view of the fire detector taken along the line B—B as shown in FIG. 12A.

According to FIG. 12A, FIG. 12B, FIG. 12C, and FIG. 13, the reference numeral 50 denotes a heat and smoke complex type fire detector. Further, the reference numeral 51 denotes a cover, the reference numeral 52 denotes a circuit board, the reference numeral 53 denotes a heat detecting element which is a thermistor or the like, and the reference numeral 54 denotes a smoke detecting room. Other parts which are the very same as one of the above-described embodiment, are given the same reference numerals. A detailed explanation about light emitting element or the like which is formed on the circuit board 52 of FIG. 13, is omitted.

The fire detector 50 is a heat and smoke multi-sensor.

The heat detecting element 53 is provided at the center of the smoke detecting room 54, as shown in FIG. 13. When the fire detector 50 detects both heat and smoke, the fire detector 50 can detect a fire.

An external portion of the fire detector 50 is composed of a base 31, a body case 30, a light guide member 20, and a cover 51.

The base 31, the body case 30, the light guide member 20 of them is the very same as parts of the fire detector 10. Only the cover 51 is different from the cover 11 of the fire detector 10.

On the rear side of the cover 51, four engaging pawls 51*a*, third reflecting surface 51*d*, or the like are formed as well as the cover 11. Air fins 56 and 56 . . . for introducing a surrounding air are formed on the cover 51. An element receiving part 55 having an opening which is faced to the heat detecting element 53 and communicated with the air, is formed at the center position of the cover 51.

The base 31, the body case 30, and the light guide member 20, of the fire detector 50, are the same members as one of the fire detector 10. Only the cover 51 is used a different member from one of the fire detector 10.

It is not desirable that means of detecting of the fire detector has a specific direction. Therefore, a detecting sensor as a light detecting element or a heat detecting element should be attached to the central position regardless of the kind of fire detector. Accordingly, it is necessary to change the shape or the like, of the cover for covering the central portion individually for each type of fire detectors. In other words, it is not necessary to change members except of the cover for covering the central portion.

According to the fire detector 10 and the fire detector 50, the light emitting surface, for example, each of the emitting surfaces 22*a* and 84, which performs the function of the indication lamp, is formed in a ring shape. As a result, it is possible to use common members for composing the covering body, except of the cover, by changing only the cover of the fire detector corresponding to the method of detecting the fire.

Accordingly, corresponding to the different type of fire detector, the covering body can be composed of the common parts and so on, regardless to the type of fire detector. As a result, it is possible to produce a fire detector having a more simple production process at a lower cost.

The entire disclosure of Japanese Patent Application No. Tokugan hei-11-122757 filed on Apr. 28, 1999 and Japanese Patent Application No. Tokugan 2000-16138 filed on Jan. 25, 2000, each including specification, claims, drawings and summary are incorporated herein by reference in its entirety.

According to the present invention, some effects will be explained, as follows.

The indication lamp of the fire detector is formed in the predetermined shape not having a specific direction. Accordingly, it is possible to recognize the operating state of the indication lamp easily and to observe whether the fire detector is operating or not from any direction.

Because the indication lamp is formed in a ring shape, when the cover of the top portion of covering body covering the fire detector is only changed, it is possible to apply for various kinds of fire detectors easily. As a result, it is to reduce the production cost for the fire detector.

The light guide member introduces the light emitted from the light source to the indication lamp with the predetermined shape, to make the indication lamp. Accordingly, it is possible to observe whether the fire detector is operating or not from every direction. Further, it is possible to arrange internal parts as well as one of the conventional fire detector. As a result, it is possible to preferably realize the fire detector of the present invention.

The light guide member comprises a plurality of light incident parts so that the amount of light which is introduced throughout the light guide member becomes bigger. Accordingly, the luminance of indication lamp increases. As a result, it is possible to see the indication lamp clearly.

The light incident part is extended from the light emitting part toward the light source. Accordingly, it is possible to position the top portion of the light incident part in the vicinity of the light source.

When the light source is surface-mounted on the circuit board, it is not necessary to connect the light source with the circuit board through a lead line or the like. Accordingly, it is possible to decrease the number of parts or assembly processes when producing it. As a result, it is possible to reduce the production cost thereof.

When the end portion of the light incident part is formed in a lens-like shape, the light which enters the light incident part from the light source, is changed to an approximate parallel light thorough the end portion which is formed in a lens-like shape, of the light incident part. Accordingly, it is possible to control the loss of the light at the minimum.

When the end portion of the light incident part is formed so as to become smaller gradually, the light which enters the light incident part from the light source, is concentrated toward the traveling direction of light through the end portion of the light incident part. Accordingly, it is possible to introduce more light to the light emitting part.

The light which enters the light incident part from the light source is introduced by the light introducing part, to be transmitted through the light emitting part. Accordingly, it is possible to efficiently transmit the light through the light emitting part.

When the notch which performances the function of the light introducing part has a V-like shape, it is easy to shape the notch having a V-like shape or the like. Accordingly, it is possible to easily form the light introducing part.

When at least one portion of the surface which forms the light emitting part, except of the emitting surface, is covered with the light reflecting member, the light emitted from the surface except of the emitting surface, is returned in the interior of the light emitting part by being reflected by the light reflecting member. Accordingly, it is possible to efficiently emit the light only from the emitting surface. As a result, it is possible to provide an indication lamp which can be seen clearly.

When the light reflecting member is one portion of the covering body, it is possible to cover the light emitting part with the light reflecting member only by incorporating the light guide member in the covering body. Accordingly, it is possible to easily realize the present invention without increasing of the number of assembly processes.

Because the emitting surface on the light guide member is formed so as to incline to both side and lower surfaces on the covering body, when such the fire detector is attached to a ceiling, it is possible for surrounding people to see the indication lamp from just under and from oblique under of the fire detector. Accordingly, it becomes much easier to observe whether the fire detector is operating or not.

The light from the light emitting part performs more complicatedly reflection and the like repeatedly by a large number of micro grooves or micro protrusions which are formed in the light emitting part. Accordingly, the luminance of light emitted from the emitting surface becomes bigger. As a result, it is possible to provide an indication lamp which can be seen more clearly.

The larger the length from the light incident part is, the larger the density of micro structural parts is. Accordingly, the amount of light emitted from the whole emitting surface on the light emitting part becomes uniform. As a result, it is easy to recognize the indication lamp clearly from anywhere when the indication lamp emits the light from the light source.

Because the micro structural parts is formed so as to be distributed uniformly throughout the light emitting part, it looks better, especially when no light is emitted.

When light scattering particles is contained in the interior of the light emitting part, the light of the interior of the light emitting part performs more complicatedly reflection and the like repeatedly by light scattering particles. Accordingly, the amount of light emitted from the emitting surface becomes larger. As a result, it becomes to recognize the indication lamp clearly from anywhere.

The larger the length from the light incident part is, the larger the number of light scattering particles contained in the interior of the light emitting part is. Accordingly, the amount of light emitted from the whole emitting surface on the light emitting part becomes uniform. As a result, it is possible to see the lighted indication lamp clearly when the indication lamp emits the light.

When light scattering particles are contained uniformly throughout the light emitting part, it looks better especially when no light is emitted.

The portion near the light incident part in the light emitting part is the thickest. Further, the larger the length from the light incident part is, the thinner the thickness thereof is. Accordingly, the light travels in various directions through the light emitting part. Consequently, it is possible to efficiently transmit the light throughout the light emitting part. As a result, the light emitted from the emitting surface becomes stronger. Further, the sighted recognition of the indication lamp from the outside thereof is improved.

Because the emission of light by the indication lamp can be stopped, it is possible to put the light off, for example, during the night, as occasion demands.

Because the amount of light emitted from the indication lamp is changed, it is possible to reduce the amount of light to lower the light, for example, during the night, as occasion demands.

Because a plurality of light sources are provided and it is possible to change the number of the light sources for emitting lights, it is possible to reduce the number of light sources for emitting lights, to reduce the amount of light emitted from the indication lamp, for example, during the night, as occasion demands.

Accordingly, the main effect thereof is the high sighted recognition in that the fire detector has enough brightness and can be observed from every direction. However, when the indication lamp thereof is used for carrying out the current-carrying indication, the indication lamp may give an anxiety for a people who is in a room at a bedtime during the night or the like or prevent the person from sleeping. However, it is possible to stop emitting the light by the indication lamp or to reduce the amount of light thereof. As a result, it is possible to control the indication lamp to be the appropriate state at a bedtime during the night or the like.

The opening is formed at the center of the body case, and further, the opening is covered with the cover which is a part other than the body case. Accordingly, by changing the shape of the cover, it is possible to provide a covering body which can be applied for various types of fire detectors.

That is, for example, when the fire detector is a light scattering type smoke detector, the simple cover not having the special structure may be used as a cover. When the fire detector is a heat and smoke complicated type detector or a heat type detector, the cover having the shape with the space for receiving the heat sensing element therein may be used as a cover.

Accordingly, it is possible to change the type of the covering body individually of fire detectors, by only exchanging the cover of the covering body. As a result, it is not necessary to design and manufacture the covering body individually for each type so that it is possible to reduce the production cost thereof.

Specially, the fire detector further comprises the indication lamp which is formed in a ring shape. Accordingly, it is possible to observe the indication lamp clearly from every direction. As a result, it is possible to provide an excellent fire detector which has the good sighted recognition and requires only the lower production cost for the fire detector.

What is claimed is:

1. A fire detector comprising:

a circuit board in which a circuit for detecting a fire is formed;

a light source which is connected with the circuit board; and an indication lamp for indicating the fire detector being under detection by emitting a light emitted from the light source, wherein the indication lamp is formed in a predetermined shape substantially centered on a central line which passes through a top portion of a covering body.

2. A fire detector as claimed in claim 1, wherein the predetermined shape has a ring shape, a plate-like shape, a cylinder-like shape, or a shape having a pattern which is formed continuously and regularly along a circle.

3. A fire detector as claimed in claim 1, wherein the indication lamp comprises a light guide member for introducing the light emitted from the light source into the indication lamp with the predetermined shape.

4. A fire detector as claimed in claim 3, wherein the light guide member comprises a light incident part which receives the light emitted from the light source and a light emitting part which communicates with the light incident part and has an emitting surface for emitting a light from the light incident part to an outside thereof.

5. A fire detector as claimed in claim 4, wherein the light guide member comprises a plurality of light incident parts.

6. A fire detector as claimed in claim 4, wherein the light incident part is extended from the light emitting part.

7. A fire detector as claimed in claim 4, wherein the light guide member comprises a light introducing part for introducing the light from the light incident part so that the light is transmitted through the light emitting part.

8. A fire detector as claimed in claim 7, wherein the light introducing part comprises a notch which is formed in the light emitting part.

9. A fire detector as claimed in claim 4, wherein a large number of micro structural parts each of which has at least either micro grooves or micro protrusions, are formed in a surface of the light emitting part.

10. A fire detector as claimed in claim 9, wherein micro structural parts are formed so as to be distributed uniformly throughout the light emitting part.

11. A fire detector as claimed in claim 1, wherein an emission of a light by the indication lamp can be stopped.

12. A fire detector as claimed in claim 1, wherein an amount of light emitted from the indication lamp can be changed.

13. A fire detector as claimed in claim 1, wherein a plurality of light sources are provided and a number of light sources for emitting lights can be changed.

14. A fire detector comprising:

a covering body which comprises a body case with an opening formed at least at a center thereof and a cover for covering the opening; and an indication lamp which is formed in a ring shape.

15. The detector of claim 9, wherein the micro grooves and micro protrusions reflect light.

16. A detector comprising:

a circuit board including a circuit to detect a fire;

a light source connected to said circuit board; and an indication lamp to indicate the detector being under detection by emitting a light emitted from said light source, said indication lamp being formed in a predetermined shape substantially centered on a central line passing through a top portion of a covering body.

17. The detector of claim 16, wherein the indication lamp emits visible light, the visible light being visible from an outside of the detector.

18. The detector of claim 16, wherein the predetermined shape is a ring shape.

* * * * *